United States Patent [19]

Salem et al.

[11] Patent Number: 4,741,741

[45] Date of Patent: May 3, 1988

[54] CHEMICAL BENEFICIATION OF COAL

[75] Inventors: George F. Salem, Cleveland Heights; Angela M. Schmidt, Brunswick, both of Ohio

[73] Assignee: The Standard Oil Company, Cleveland, Ohio

[21] Appl. No.: 920,528

[22] Filed: Oct. 17, 1986

[51] Int. Cl.[4] ..... C10L 9/02

[52] U.S. Cl. ..... 44/621; 44/627; 44/624; 201/17; 423/461

[58] Field of Search ..... 44/1 SR, 1 R; 201/17; 423/460, 461

[56] References Cited

U.S. PATENT DOCUMENTS

| | | | |
|---|---|---|---|
| 2,624,698 | 1/1953 | Hickey | 202/25 |
| 2,808,369 | 10/1957 | Hickey | 423/461 |
| 3,993,455 | 11/1976 | Reggel et al. | 44/1 SR |
| 3,998,604 | 12/1976 | Hinkley | 202/10 |
| 4,055,400 | 10/1977 | Stambaugh et al. | 44/1 SR |
| 4,071,328 | 1/1978 | Sinke | 44/1 SR |
| 4,083,801 | 4/1978 | Das | 423/449 |
| 4,083,940 | 4/1978 | Das | 423/449 |
| 4,127,390 | 11/1978 | Dondelewski | 44/1 SR |
| 4,134,737 | 1/1979 | Yang | 44/1 R |
| 4,167,397 | 9/1979 | Grant | 44/1 SR |
| 4,169,710 | 10/1979 | Jensen | 44/1 SR |
| 4,305,726 | 12/1981 | Brown, Jr. | 44/1 SR |
| 4,328,002 | 5/1982 | Bender | 44/1 SR |
| 4,408,999 | 10/1983 | Nadkarni et al. | 44/1 SR |
| 4,424,062 | 1/1984 | Kamino et al. | 44/1 SR |
| 4,516,980 | 5/1985 | Wheelock | 44/1 SR |
| 4,618,346 | 10/1986 | Schapiro et al. | 44/1 SR |

FOREIGN PATENT DOCUMENTS

| | | | |
|---|---|---|---|
| 0016624 | 10/1980 | European Pat. Off. . | |
| 0134530 | 3/1985 | European Pat. Off. . | |
| 8202404 | 7/1982 | World Int. Prop. O. | 44/1 SR |
| 653361 | 12/1985 | Switzerland | 44/1 R |
| 1286038 | 8/1972 | United Kingdom | 423/461 |

*Primary Examiner*—Carl F. Dees

*Attorney, Agent, or Firm*—Bruce E. Harang; David J. Untener; Larry W. Evans

[57] ABSTRACT

Chemical beneficiation of coal and other carbonaceous solids utilizing hydrofluoric acid and ammonium chloride.

14 Claims, 1 Drawing Sheet

CHEMICAL BENEFICIATION OF COAL

BACKGROUND OF THE INVENTION

This invention relates to the beneficiation of coal and similar carbonaceous solids which contain impurities in the form of ash-forming, inorganic constituents, commonly referred to as mineral matter, and inorganic and organic sulfur.

Known resources of coal and other solid carbonaceous fuel materials in the world are far greater than the known resources of petroleum and natural gas combined Despite this enormous abundance of coal and related solid carbonaceous materials, reliance on these resources, particularly coal, as primary sources of energy, has been discouraged for the most part. The availability of cheaper, cleaner burning, more easily retrievable and transportable fuels, such as petroleum and natural gas, has in the past, cast coal to a largely supporting role in the energy field.

As a result, enormous efforts are being extended to make coal and related solid carbonaceous materials equivalent or better sources of energy, than petroleum or natural gas. In the case of coal, for example, much of this effort is directed to overcoming the environmental problems associated with its production, transportation and combustion. For example, health and safety hazards associated with coal mining have been significantly reduced with the onset of new legislation governing coal mining. Furthermore, numerous techniques have been explored and developed to make coal cleaner burning, more suitable for burning and more readily transportable.

Gasification and liquefaction of coal are two such known techniques. Detailed descriptions of various coal gasification and liquefaction processes may be found, for example, in the Encyclopedia of Chemical Technology, Kirk-Othmer, Third Edition (1980) Volume 11, pages 410–422 and 449–473. However, these techniques, typically, require high energy input, as well as the utilization of high temperature and high pressure equipment, thereby reducing their widespread feasibility and value.

In addition to gasification and liquefaction, other methods for converting coal to more convenient forms for burning and transporting are also known. For example, the preparation of coal-oil and coal-aqueous mixtures are described in the literature. Such liquid coal mixtures offer considerable advantages. In addition to being more readily transportable than dry solid coal, they are more easily storable, and less subject to the risks of explosion by spontaneous ignition. Moreover, providing coal in a fluid form makes it feasible for burning in conventional apparatus used for burning fuel oil. Such a capability can greatly facilitate the transition from fuel oil to coal as a primary energy source.

Regardless of the form in which the coal is ultimately employed, the coal or coal combustion products must be cleaned because they contain substantial amounts of sulfur, nitrogen compounds and mineral matter, including significant quantities of metal impurities like, aluminosilicates, metal oxides, metal pyrites, metal sulfates, etc. During combustion these materials enter the environment as sulfur dioxide, nitrogen oxides and compounds of metal impurities. If coal is to be accepted as a primary energy source, it must be cleaned to prevent pollution of the environment either by cleaning the combustion products of the coal or cleaning the coal prior of burning.

Accordingly, physical as well as chemical coal cleaning (beneficiation) processes have been explored. In general, physical coal cleaning processes involve pulverizing the coal to release the impurities, wherein the fineness of the coal generally governs the degree to which the impurities are released. However, because the costs of preparing the coal rise exponentially with the amount of fines to be treated, there is an economic optimum in size reduction. Moreover, grinding coal even to extremely fine sizes may not be effective in removing all the impurities. Based on the physical properties that effect the separation of the coal from the impurities, physical coal cleaning methods are generally divided into four categories: gravity, flotation, magnetic and electrical.

In contrast to physical coal cleaning, chemical coal cleaning techniques are in a very early stage of development. Known chemical coal cleaning techniques include oxidative desulfurization of coal (sulfur is converted to a water-soluble form by air oxidation), ferric salt leaching (oxidation of pyritic sulfur with ferric sulfate), and hydrogen peroxide-sulfuric acid leaching. Other methods are also disclosed in the above-noted reference to the Encyclopedia of Chemical Technology, Volume 6, pages 314–322.

Furthermore, the patent literature is replete with chemical coal beneficiation processes. For example, U.S. Pat. No. 4,424,062 discloses a process for chemically removing ash from coal by immersing ash containing coal in an aqueous solution containing hydrochloric acid or citric acid in combination with acidic ammonium fluoride. U.S. Pat. No. 3,993,455 discloses a process for removing mineral matter from coal by the treatment of the coal with aqueous alkali such as sodium hydroxide, followed by acidification with strong acid. Similarly, U.S. Pat. No. 4,055,400 discloses a method of extracting sulfur and ash from coal by mixing the coal with an aqueous alkaline solution, such as ammonium carbonate.

U.S. Pat. No. 4,071,328 discloses a method of removing sulfur from coal by first hydrogenating the coal and the hydrogenated coal is subsequently contacted with an aqueous inorganic acid solution. U.S. Pat. No. 4,127,390 discloses a process for reducing the sulfur content of coal by treatment with an aqueous sodium chloride solution. U.S. Pat. No. 4,134,737 discloses a process for the production of beneficiated coal wherein the coal is digested in caustic, then treated in mineral acid and then treated in nitric acid.

U.S. Pat. No. 4,083,940 discloses a process for cleaning coal by contacting the coal with an aqueous leaching solution containing nitric and hydrofluoric acid. U.S. Pat. No. 4,169,710 discloses comminuting and cleaning coal of sulfur and ash by contacting the coal with a hydrogen halide, such as HF (aqueous and/or anhydrous).

U.S. Pat. No. 4,408,999 discloses beneficiating coal by subjecting the coal to electromagnetic radiation in the presence of a strong inorganic acid, such as hydrofluoric acid. In turn, U.S. Pat. No. 4,305,726 discloses a chemical method of treating coal to remove ash and sulfur comprising treating the coal with hydrochloric and hypochlorous acid in the presence of ferric and ferrous sulfate, while U.S. Pat. No. 4,328,002 discloses a method of treating coal to remove ash and sulfur involving preconditioning coal particles in the presence of an aqueous solution of an oxidant, such as $H_2O_2$ or HF, washing the so-treated coal, treating the washed coal with further oxidant and then passivating the coal with for example, an ammonium salt and then neutralizing with alkali metal hydroxide.

U.S. Pat. No. 4,516,980 discloses a process for producing low-ash, low sulfur coal by a two-stage alkaline treatment using sodium carbonate or bicarbonate as the reagent. The alkaline treated coal is then extracted with aqueous mineral acid; and U.S. Pat. No. 3,998,604 discloses a coal demineralization process whereby ground coal is treated with aqueous acid, such as HCl, $H_2SO_4$ or $H_2CO_3$ and then subjected to froth flotation in the presence of a gas selected from $Cl_2$, $SO_2$ or $CO_2$.

Although HCl has been found effective in the removal of certain types of mineral matter from coal, processes that utilize HCl in any form run the risk of chlorinating the aromatic and heteroatomic organic matrix found in coal. The chlorine cannot be removed from the chlorinated coals by simple washing or drying under vacuum. The corrosiveness of Cl liberated from combusted coal is well known. On the other hand, while it is also known that HF is very effective in removing silica and alumina from coal, it is not so effective in removing divalent alkali metals, such as calcium and magnesium. Furthermore, as also evidenced above, several prior art processes utilize oxidizing acids such as $HNO_3$ and $H_2SO_4$. Although they may aid in the removal of mineral matter, they are also very capable of oxidizing the organic coal matrix, thereby decreasing the amount of volatile matter and the heating value of the coal.

SUMMARY OF THE INVENTION

Accordingly, it is one object of the present invention to provide a beneficiation process for coal and other carbonaceous solids.

It is another object of this invention to provide a beneficiation process which provides ultra-clean coal and other carbonaceous solids.

Still another object of the present invention is to provide a chemical beneficiation process for coal which provides ultra-clean coal without many of the heretofore identified disadvantages associated with prior art processes.

These and other objects are accomplished herein by providing a process for beneficiating coal or other solid carbonaceous matter comprising the steps of:

(i) contacting particulate coal or other solid carbonaceous matter with hydrofluoric acid;

(ii) mixing the mineral-depleted coal or other solid carbonaceous matter resulting from step (i) with an ammonium chloride solution, preferably aqueous ammonium chloride; and (iii) recovering the resultant beneficiated coal or other solid carbonaceous matter.

DETAILED DESCRIPTION OF THE INVENTION

Figure 1:
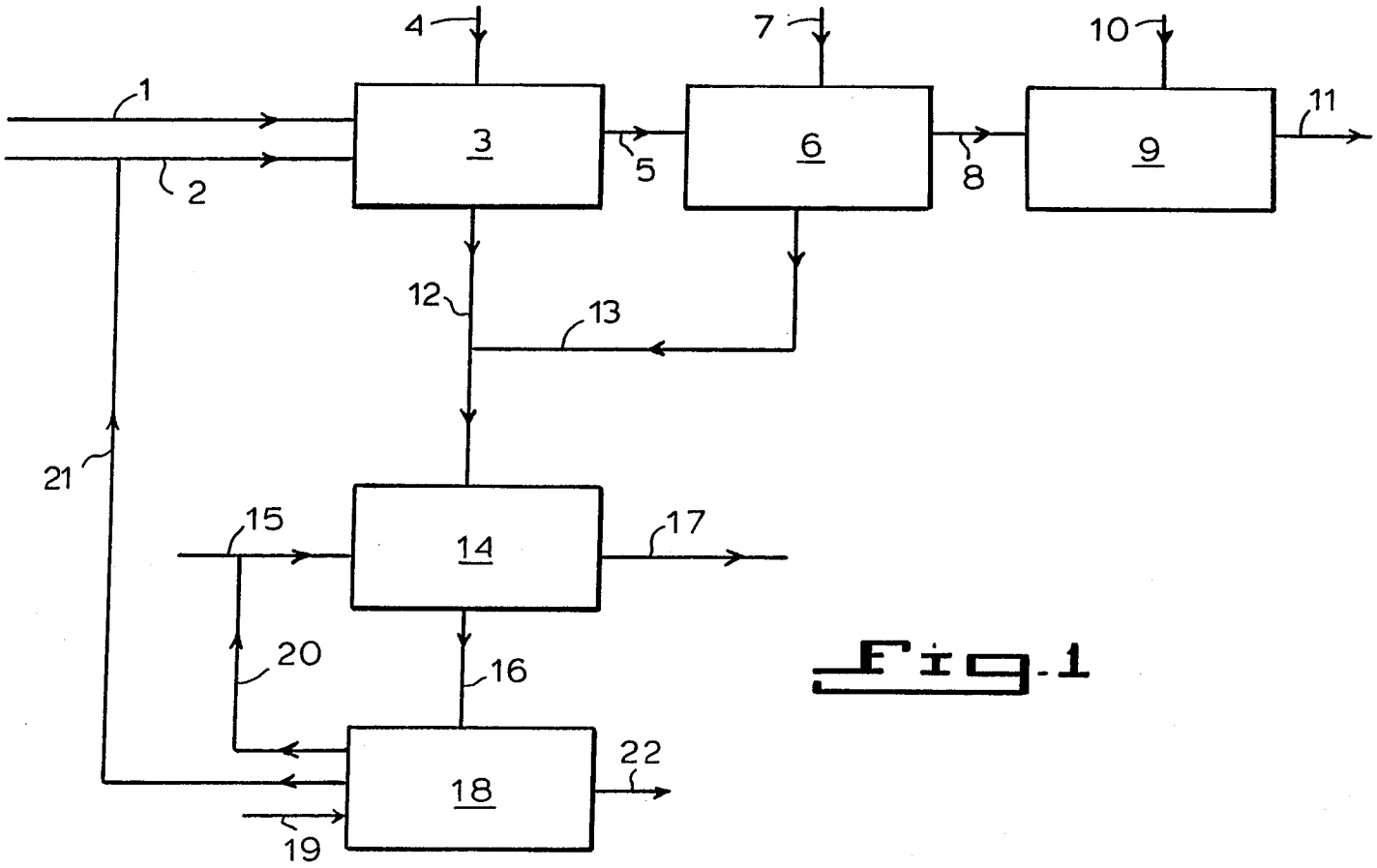
FIG. 1 is a schematic flow diagram depicting a beneficiation process carried out in accordance with the present invention.

In accordance with the present invention, clean coal, which is particularly well-suited for use in the preparation of coal aqueous slurries, is provided by a unique and improved chemical beneficiation process.

The process according to this invention, depicted in the drawing, is one for the chemical beneficiation of any type of coal. Typically, these include, for example, bituminous coal, sub-bituminous coal, anthracite, lignite and the like. Other solid carbonaceous fuel materials such as oil shale, tar sands, coke, charcoal, char, gasification residues, liquefaction residues, pyrolysis residues, graphite, mine tailings, coal from refuse piles, coal processing fines, coal fines from mine ponds or tailings, carbonaceous fecal matter and the like which contain inorganic, ash-forming constituents may also be beneficiated by the present process. Thus, for the purposes of this invention, the term "coal" is also intended to include these kinds of other solid carbonaceous fuel materials or streams.

In the process depicted in the drawing, pulverized coal, for example, 80% minus 75 microns, is passed through line 1 into stirred reactor tank 3 in which the coal is admixed with aqueous hydrofluoric acid introduced to reactor 3 via line 2. While aqueous hydrofluoric acid is the preferred source of hydrofluoric acid, other sources of hydrofluoric acid, such as, for example, liquid HF, acidic ammonium fluoride and the like which will generate hydrofluoric acid in situ are within the scope of the present invention. While not shown in the drawing, the present process may comprise means for providing pulverized coal, such as for example, a rotary crusher or similar fragmenting device where the coal particles are ground, crushed or other wise reduced in size to form smaller particles. The amount of inorganic constituents that is removed from the crushed solids depends upon the size of the particles. Normally, the smaller the particles, the greater is the removal of inorganic constituents. It is, however, undesirable to crush or grind to very small particles since this requires a relatively large input of energy.

The aqueous hydrofluoric acid solution introduced through line 2 can range in concentration, e.g., from about 10 to about 50 wt. % HF. In any event and regardless of the source of hydrofluoric acid utilized, sufficient acid is introduced to provide a suitable amount to retain the dissolved mineral matter in solution and further to enable the solution to stir with a minimum effort. Typical amounts of acid include for example from about 1 to about 5 liters per kilogram of coal. The solution in reactor 3 can be stirred with or without added agitation from the introduction of inert gas, e.g., air, nitrogen, etc., bubbled into the solution through line 4.

The temperature of reactor tank 3 will normally be in the range of from about 25° to about 100° C., preferably about 50° C. The residence time of the coal slurry and aqueous hydrofluoric acid solution in reactor 3 generally depends upon the temperature in the reactor, size of coal, solids content, acid concentration and the starting mineral matter content. Generally the residence time ranges from about 3 minutes to about 60 minutes. It is found that the aqueous hydrofluoric acid is extremely effective in the removal of silica and alumina, which comprise the majority of the inorganic constituents found in coal.

The mineral-depleted coal is filtered and passed through line 5 into a water wash zone 6 where essentially all of the remaining acid solution is removed from the solids. The water wash zone will normally comprise a multistage extraction system with water introduced through line 7. A dilute acid solution containing dissolved mineral matter is removed from reactor 6 through line 13, mixed with the concentrated aqueous acid solution removed from reactor 3 through line 12, and passed into acid regeneration unit 14.

After washing, the coal solids are passed through line 8 into stirred reactor 9. A solution of ammonium chloride, preferably an aqueous ammonium chloride solution is introduced to reactor 9 through line 10. The ammonium chloride is effective in the removal of divalent alkali fluorides that are not appreciably soluble in aqueous hydrofluoric acid. The concentration of the ammonium chloride solution ranges from about 1 to about 30 wt. % ammonium chloride (upper solubility limit) and is coal specific. Typically, a concentration of about 5 wt. % to about 10 wt. % is preferred. The temperature in reactor 9 will normally be in the range of about 25° to about 50° C., with 50° C. being the most preferred. Residence times range up to about one hour. The low-ash coal is separated by filtration, washed with water and may then be sent through line 11 to a slurry preparation facility.

The HF can be recovered by any of several procedures, the preferred procedure utilizes calcium hydroxide. The aqueous acid solutions containing dissolved inorganic matter, such as fluorosilicic acid ($H_2SiF_6$) are treated with an aqueous calcium hydroxide solution introduced through line 15 in reactor 14. The aqueous calcium hydroxide solution has a concentration in the range of from about 5 to about 30 wt. % calcium hydroxide. The fluorosilicic acid reacts with the calcium hydroxide to form calcium fluoride according to the following equations:

$$SiO_2+4HF \rightarrow SiF_4+2H_2O$$

$$SiF_4+2HF \rightarrow H_2SiF_6$$

$$H_2SiF_6+3Ca(OH)_2 \rightarrow 2CaF_2+4H_2O+SiO_2$$

The silica formed is separated from the calcium fluoride by simple centrifugation and removed through line 17. The calcium fluoride produced is in a pure enough state for the subsequent regeneration step. Typically, the reaction in reactor 14 is carried out a temperature of about 50° C. The residence time of the solution in reactor 14 is typically 30 minutes.

The aqueous solution containing mostly calcium fluoride is fed by line 16 into reactor 18 removing the water e.g. by filtration via line 20. An excess of 98% sulfuric acid is added to reactor 18 through line 19 and the reactor is maintained at a temperature of 200° C. for approximately 30 minutes. The acid reactor 18 serves to regenerate hydrofluoric acid according to the following equation:

$$CaF_2+H_2SO_4 \rightarrow CaSO_4+2HF$$

The vaporized hydrogen fluoride is passed through line 21, condensed and mixed with fresh acid for reuse. The calcium sulfate and other mineral salts are withdrawn through line 22.

While aqueous calcium hydroxide is a preferred reactant in the present process for regeneration of HF, other reactants in place thereof are also contemplated. These include, for example, calcium oxide (CaO), aluminum oxide ($Al_2O_3$), magnesium oxide (MgO), magnesium hydroxide, aluminum hydroxide and the like. Thus, for example, if aluminum hydroxide is employed, the aqueous acid solutions containing dissolved inorganic matter, such as fluorosilicic acid ($H_2SiF_6$), are treated with aqueous aluminum hydroxide solution introduced through line 15 in reactor 14. The fluorosilicic acid reacts with the aluminum hydroxide to form aluminum fluoride according to the following equations:

$$SiO_2+4HF \rightarrow SiF_4+2H_2O$$

$$SiF_4+2HF \rightarrow H_2SiF_6$$

$$H_2SiF_6+2Al(OH)_3 \rightarrow AlF_3+4H_2O+SiO_2$$

The silica formed precipitates out of solution and is separated by filtration and removed through line 17. The aluminum fluoride produced is soluble in an aqueous solution. The aqueous solution containing mostly aluminum fluoride is fed by line 16 into reactor 18, removing the water via line 20, e.g. by filtration. Enough water is added to insure that a density of about 0.3 g/cc is obtained and the reactor is heated to a temperature of 425° C. for approximately 30 minutes. The aluminum fluoride is hydrolyzed to aluminum hydroxide, which is insoluble in water, thus regenerating HF. The vaporized hydrogen fluoride is passed through line 21, condensed and mixed with fresh acid for re-use. The aluminum hydroxide and other mineral salts are withdrawn through line 22.

Thus, as evidenced by the above discussion, the present process provides a unique approach to providing clean coal. That is, the present process (1) combines physical beneficiation (grinding) with subsequent chemical beneficiation to optimize mineral matter removal, (2) utilizes ammonium chloride ($NH_4Cl$) as a chloride source, to remove alkali metals that are not removed by HF, without the detrimental chlorination of the organic matrix and (3) results in the high recovery of HF by essentially conventional technology.

Obviously, other modifications of variations of the present invention are possible in the light of the above teachings. It is, therefore, to be understood that changes may be made in the particular embodiments of this invention which are within the full intended scope of the invention or defined by the appended claims.

What is claimed is:

1. A process for the beneficiation of carbonaceous solids containing inorganic, ash-forming constituents, including silica, alumina and metal-containing compounds, said process comprising the steps of:

(i) mixing said carbonaceous solids with hydrofluoric acid;

(ii) mixing the mineral depleted carbonaceous solids resulting from step (i) with ammonium chloride solution; and (iii) recovering the resultant beneficiated carbonaceous solids.

2. The process according to Claim 1 wherein said hydrofluoric acid is provided by a source of hydrofluoric acid selected from the group consisting of aqueous hydrofluoric acid, liquid hydrofluoric acid and acidic ammonium fluoride.

3. The process according to claim 1 wherein said hydrofluoric acid is aqueous hydrofluoric acid.

4. The process according to claim 1 wherein said ammonium chloride solution is an aqueous ammonium chloride solution.

5. The process according to Claim 1 wherein said carbonaceous solids is selected from the group consisting of pulverized coal, micronized coal and coal tailings.

6. The process according to Claim 1 wherein said carbonaceous solids resulting from step (i) are treated to remove hydrofluoric acid prior to mixing with aqueous ammonium chloride solution in step (ii).

7. The process according to claim 6 wherein the treatment to remove hydrofluoric acid comprises water washing.

8. The process aocording to claim 1 wherein the hydrofluoric acid resulting from step (i) containing dissolved inorganic matter is contacted with an aqueous solution of a compound selected from the group consisting of calcium hydroxide, calcium oxide, aluminum hydroxide, aluminum oxide, magnesium oxide and magnesium hydroxide.

9. The process according to Claim 3 wherein the aqueous hydrofluoric acid solution resulting from step (i) and containing dissolved inorganic matter is contacted with aqueous calcium hydroxide solution to form aqueous calcium fluoride solution and said aqueous calcium fluoride solution is reacted with sulfuric acid to regenerate hydrogen fluoride vapor.

10. The process according to Claim 9 wherein said hydrogen fluoride vapor is condensed and recycled to step (i).

11. The process according to Claim 1 wherein said hydrofluoric acid used in step (i) is an aqueous hydrofluoric acid solution having a concentration in the range of from about 10 to about 50% by weight hydrofluoric acid.

12. The process according to Claim 9 wherein said aqueous calcium hydroxide has a concentration in the range of from about 5 to about 30 wt. % calcium hydroxide.

13. The beneficiated carbonaceous solids resulting from the process of claim 1.

14. The beneficiated coal resulting from the process of claim 9.

* * * * *